US005341512A

United States Patent [19]

Noble

[11] Patent Number: 5,341,512

[45] Date of Patent: Aug. 30, 1994

[54] VISION LIMITING DEVICE

[76] Inventor: Casey Noble, 106 Brandon Hall Dr., Columbus, Ga. 31909

[21] Appl. No.: 110,113

[22] Filed: Aug. 20, 1993

[51] Int. Cl.[5] ..... A42B 3/02; A42B 1/24

[52] U.S. Cl. ..... 2/6.2; 2/422

[58] Field of Search ..... 2/6, 422, 424, 10, 15, 2/6.2, 6.1

[56] References Cited

U.S. PATENT DOCUMENTS

| | | | |
|---|---|---|---|
| 3,629,870 | 12/1971 | Paisley | 2/15 |
| 4,575,875 | 3/1986 | Dawson et al. | 2/422 |
| 4,744,107 | 5/1988 | Fohl | 2/422 |
| 4,817,633 | 4/1989 | McStravick et al. | 128/782 |
| 4,907,296 | 3/1990 | Blecha | 2/6 |
| 4,922,550 | 5/1990 | Verona et al. | 2/6 |
| 4,987,608 | 1/1991 | Cobb | 2/422 X |

*Primary Examiner*—Peter Nerbun
*Attorney, Agent, or Firm*—Hopkins & Thomas

[57] ABSTRACT

The vision limiting device, commonly known as a hood 40 comprises a unitary frame structure 41 having an inverted U-shape when in its operative position. The frame structure 41 includes a top wall 43 joining two spaced side walls 42 and 44, wherein when worn on the head of an aviator, the side walls 42 and 44 provide side shields for preventing peripheral view. In addition, the frame structure 41 includes a concave inner edge 45 that is shaped and configured to conform to the unique curvature of the central front outer portion of the Army sound protective helmet (SPH-4), as shown in FIG. 4. A front outer wall 46 connects the top wall 43 and side walls 44, wherein the front outer wall 46 includes a lip 48 which defines a generally inverted U-shaped cutaway opening 49. A bracket 50 supports a quick coupling means 52, which comprises a cylinder 54 having a spring loaded ball 55 on each end thereof. The quick coupling means 52 is compatible with the current quick coupling means located on the mounting structure currently used to mount an ANVIS goggle assembly. The hood 40 is easily attachable and detachable from the mounting structure of the helmet without the requirement of adapting a separate mounting structure for mounting the hood only.

6 Claims, 2 Drawing Sheets

VISION LIMITING DEVICE

FIELD OF THE INVENTION

The present invention relates generally to aviator training devices and more particularly to a vision limiting device for use with an aviator's flight helmet.

BACKGROUND OF THE INVENTION

Many devices have been devised for use with aviator helmets, such as the U.S. Army Apache aviator's helmet (AH-64) and the U.S. Army sound protective helmet (SPH-4). Such devices include mounting structures attached thereon, to which are mounted auxiliary devices such as eye-stimulating, vision-shielding, and other avionic devices. The helmet mounting structure is preferably formed of a single member having an inner concave portion that is shaped and configured to conform to the convex curvature of the central front outer portion of the helmet.

Mounting structures for the helmet must conform to certain requirements for use on the aviator's helmet. Thus, the mounting structure needs to be adaptable to the helmet without interfering with existing avionics devices mounted in the helmet, or without interfering with other aviator auxiliary devices mounted to the mounting structure. One example of a mounting structure is disclosed in U.S. Pat. No. 4,922,550 of Verona et al. Verona et al. shows a pair of interface rail adapters located on each of the right and left front sides of the helmet. These rails are attachable to existing mounting points on the U.S. Army Apache (AH-64) helmet so as to make the AH-64 compatible with the aviator's night vision imaging system (ANVIS) auxiliary goggle assembly. Previously, the ANVIS goggle assembly was only mountable on the sound protective helmet (SPH-4). However, with the implementation of the rail adapters of Verona et al., the (ANVIS) goggle assembly is capable of being mounted on the U.S. Army Apache helmet.

Another mounting structure is illustrated in U.S. Pat. No. 4,987,608 of Cobb, wherein a mounting bracket on a ground system night vision goggle assembly can be mounted on an aviator's helmet. Cobb shows that when the frame and excess padding surrounding the ground system goggle assembly are removed, the bracket of Cobb can be mounted to standard hardware on an aviator's helmet to be compatible with the ANVIS goggle assembly. A goggle assembly swiveling feature is implemented by the use of a breakaway mount having two releasably mating connectors. The first connector, usually located on the ANVIS goggle assembly comprises a cylinder mounted on a bracket, wherein the cylindrical portion includes a spring loaded ball on each end thereof. The mating connector, usually mounted on the mounting structure, is configured with channels which have a lock socket into which the spring loaded balls of the first connector slide and expand outwardly to fit snugly therein.

Similar to the patent of Verona et al., a patent to Blecha (U.S. Pat. No. 4,907,296) illustrates yet another mounting structure for mounting an ANVIS goggle assembly on the AH-64. The mounting structure is shaped to conform to the curvature of the outer front portion of the Apache helmet. Further, a breakaway mount similar to the breakaway mount shown in the patent of Cobb connects the mounting bracket to the ANVIS goggle assembly.

Other auxiliary devices for mounting on a mounting structure are also required by an aviator periodically, such as a vision limiting device, commonly known as a "hood". The hood, however, is normally mounted by its own mounting structure onto the same helmet as normally required by the ANVIS goggle assembly, the Army sound protective helmet (SPH-4). Army regulations require an aviator to fly at least three hours in weather time or with the use of a hood in his or her primary aircraft each semiannual period. Therefore, the aviator must fly either in actual Instrument Meteorological Conditions (IMC), or in simulated Instrument Meteorological Conditions with the use of a hood. Inasmuch as the current mounting structure for securing the hood to the helmet is not compatible with the ANVIS assembly, the mounting structure for attaching the ANVIS, for example, must be removed from the Army SPH-4 helmet and replaced by the mounting structure for securing the hood before the hood can be attached thereto. The breakdown of the helmet and different mounting structure is normally performed by a skilled technician and requires about 30 minutes time. This process, which has been used by aviators for about a decade is, therefore, inconvenient, time consuming and requires unique or special tools. In addition, the hoods currently in use are held in place by means of friction and can easily be knocked off or knocked askew under adverse conditions.

While prior art devices such as those disclosed in the above referenced patents appear to be somewhat successful in providing different mounting structures for converting one type of helmet for use with a different auxiliary device (U.S. Pat. No. 4,922,550 to Verona et al.); one type of mount to be compatible with different helmets (U.S. Pat. No. 4,987,608 to Cobb); or a different type of mounting structure (U.S. Pat. No. 4,907,296 to Blecha), they nevertheless exhibit shortcomings that are inherent in their respective designs. For instance, none of the patents shows the feature of using the same helmet with the same mounting structure to mount different auxiliary devices. In addition, some of the mounting structures, such as the structure of Cobb are complicated, difficult to manufacture, and appear to require excessive time and labor in conversion of the mounting structure from fitting one type of helmet to another.

Accordingly, there exists a continuing and heretofore unaddressed need for an improved auxiliary device, such as a hood, that overcomes the problems and shortcomings of the prior art by providing a hood that is positively mounted and that includes a breakaway mount that is compatible with the breakaway mounting connector already in existence. The hood should be simple, rugged, easy to manufacture, easy to install and to detach without the use of any tools and should have both an operative position and a stored position. It is to the provision of such a hood that the present invention is primarily directed.

SUMMARY OF THE INVENTION

Briefly described, the present invention, in a preferred embodiment thereof, comprises a vision limiting device or hood which is connectible to the mounting structure presently used to attach the ANVIS goggle assembly onto the Army sound protective helmet (SPH-4). The connector of the hood is compatible with the current connector of the mounting structure for the ANVIS so that the separate mounting structure currently used to mount the hood is no longer necessary.

The current mounting structure for mounting the ANVIS goggle assembly comprises a curved body having an inner concave surface shaped to conform to the unique curvature of the front outer portion of the SPH-4. Fasteners, such as screw threaded means, fasten the mounting structure to existing mounting points on the helmet. A mount for attaching auxiliary devices, such as the ANVIS goggles or the hood, is attached to the central lower or front portion of the mounting structure by a mount bracket, which is attached to the mounting structure by screw threaded means. The mount comprises a coupler having two members forming a channeled structure with a lock socket on the inner portions therebetween. In addition, a vertical adjustment knob is included so as to accommodate manipulation of the auxiliary device in a vertical position with respect to the aviator's line of sight.

The present invention comprises a hood having a frame contoured to conform to the side portions of the helmet, as well as to protrude downwardly towards the ears and forwardly in front of the aviator so as to limit the sight of the aviator to view only in the forward direction. In particular, the hood eliminates the peripheral view of the aviator. The hood of the present invention includes a centrally positioned bracket attached to the hood by screw-threaded means, wherein the bracket supports a mating connector which couples with the connector of the previously described mounting structure. The coupler of the hood comprises a cylinder mounted on the bracket, wherein the cylinder has a spring-loaded ball on each end thereof. The cylinder is mated with the connector on the mounting structure by sliding the balls of the cylinder along the channels on each side of the connecting mounting structure. Each of the channels has a lock socket into which the spring loaded balls slide into and expand outwardly to fit snugly therein.

In addition, the cylinder includes at least two grooves which run along its full length and a short transverse groove in the center thereof. These grooves are used to hold the hood either in a stow position or in its operational position. To release the cylinder from its locked position within the channel, a release means is used to release pressure on the cylinder so that the reverse sequence of moving the balls of the cylinder from the sockets and out of the channels can be accomplished.

It is therefore an object of the present invention to provide vision limiting by means which is fully adaptable to an existing mounting structure, currently used only for mounting the ANVIS goggle system.

Another object of the invention is to provide a hood herewithin described which is easily attached and detached from the head of the wearer on to the same mounting structure without the use of any tools.

It is yet another object of the present invention to provide a hood of the character herewithin described in which the hood can easily be flipped upwardly clear of the eyes when desired, a matter of convenience when a pilot is under training.

A further object of the invention is to provide a hood of the character herewithin described which is simple in construction, economical in manufacture, rugged and otherwise well suited to the purpose for which it is designed.

It is yet another object of the present invention to provide a hood which is compatible with the ANVIS goggle assembly so that the sun-protective-4 helmet and the mounting structure of the SPH-4 helmet can remain on the head of an aviator, while the ANVIS goggle system and hood are interchangeable.

A more complete understanding of the present invention will be had by those skilled in the art, as well as an appreciation of additional advantages, which will become apparent upon reading the detailed description of the preferred embodiment and examining the drawings, a brief description of which follows.

DETAILED DESCRIPTION OF THE DRAWING

Figure 1:
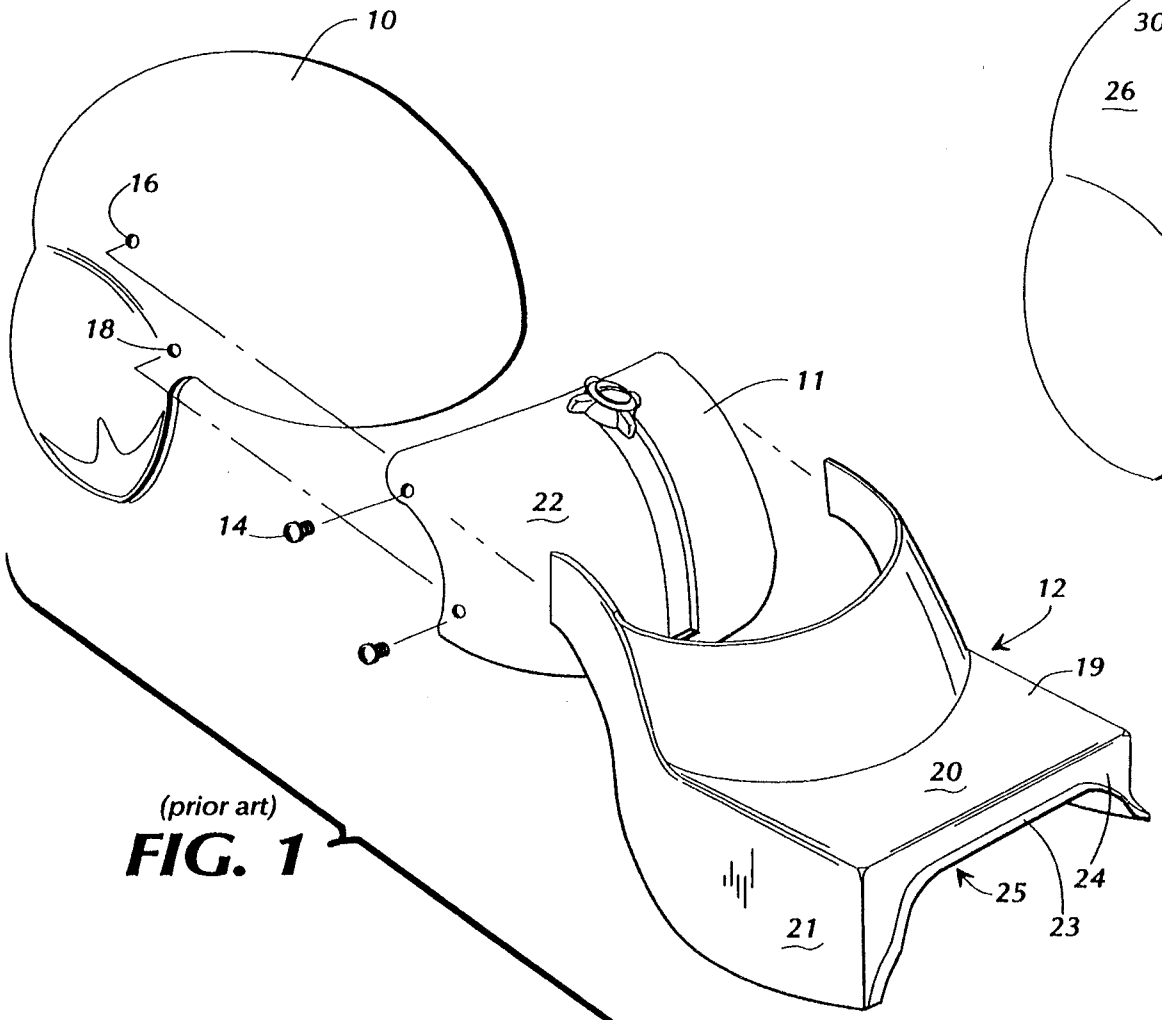
(prior art) FIG. 1
FIG. 1 is a perspective view of the SPH-4 helmet illustrating the prior art mounting structure in an exploded view.

Referring now in more detail to the drawings, in which like numerals refer to like parts throughout the several views, FIG. 1 is a perspective view of the U.S. Army Sound Protective helmet (SPH-4) 10 with a mounting structure 11 and its existing hood assembly 12. The mounting structure 11 is attached to the helmet 10 by screw threaded attachment means (14 and 15) to existing bolt hole attachment points 16 and 18 of the helmet 10. Corresponding attachment means in corresponding attachment holes of a similar configuration are also included on the other side of the helmet (not shown). When the mounting structure 11 is attached to the helmet 10, the vision limiting device or hood 12 can be secured onto the mounting structure 11 by pressing side walls 21 of the hood 12 onto the mounting structure and sides of the helmet for a friction fitted attachment. The hood 12 comprises a unitary frame body 19 having an inverted U-shaped configuration when properly positioned on the helmet 10. The hood 12 includes a horizontal top wall 20 functioning as a visor, and two side walls 21 (only one of which is shown) extending downwardly therefrom. On the hood's inner edge, a curved flange 22 (not shown) is shaped and conformed to abut and friction fit against the curvature of the front outer portion of the aviator's helmet 10 and mounting structure 11. An outer wall 24 includes a lip 23 which defines an inverted U-shaped cutaway opening 25 for the aviator to view therethrough.

Figure 2:
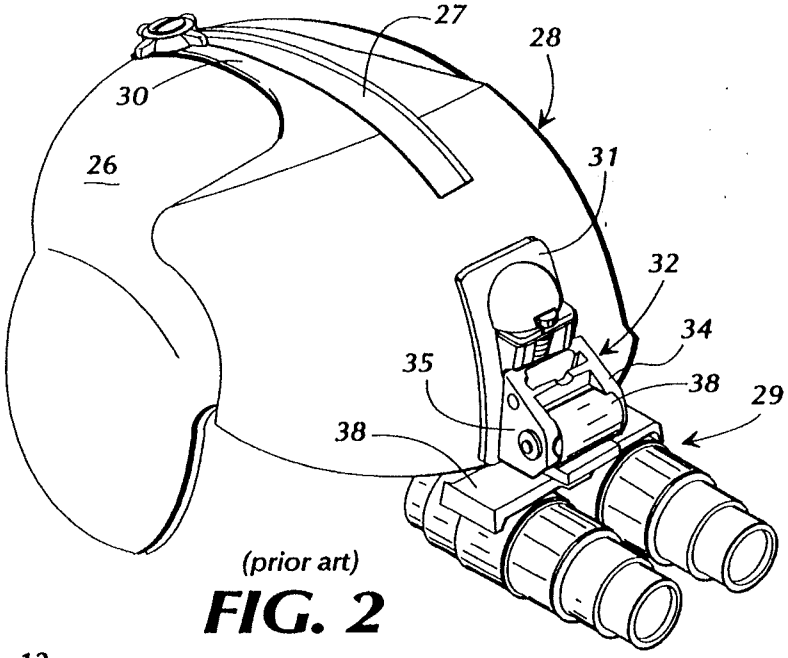
(prior art) FIG. 2
FIG. 2 is a perspective view of the prior art ANVIS goggle assembly mounted on the mounting structure and helmet of FIG. 4.

FIG. 2 shows a perspective view of an SPH-4 helmet 26 with a mounting structure 28 and an ANVIS goggle assembly 29 attached thereto. The mounting structure 28 comprises a single convex body configured to conform to the front outer portion of the helmet. In addition, a curved elongated finger 30 extends upwardly from the mounting structure 28 so as to conform to the top portion of the helmet. An elongated slot 27 is formed in the elongated finger 30 for slidably adjusting the mounting structure 28 in a vertical direction with respect to the aviator's line of sight.

A mounting bracket 31 carries a mount assembly 32, wherein the mounting bracket 31 is preferably attached to the mounting structure 28 by screw threaded means (not shown). The mount 32 comprises two opposite and opposed side members 34 and 35 forming a channel there between. Lock sockets (not shown) are included in the inner portions of each of the side members 34 and 35. When the ANVIS goggle assembly 29 is secured to the mount 32, a cylindrical coupling member 36, has a spring loaded ball on each end thereof so that the balls of the cylinder fit snugly in the lock sockets of the mount 32. The cylindrical coupling member 36 is mounted to the ANVIS goggle assembly by a mounting bracket 38. FIGS. 1 and 2 have been discussed, therefore, so as to emphasize further that the same mounting structure currently used for mounting either the hood or the ANVIS, will not support both the hood and the ANVIS goggle assembly. A different mounting structure, such as mounting structure 11 or 28, must be secured to the helmet each time its respective auxiliary device is used. It can also be seen that the hood 12, which is held in place by friction, is large and unwieldy, and adds materially to the overall weight of the helmet 10.

Figure 3:
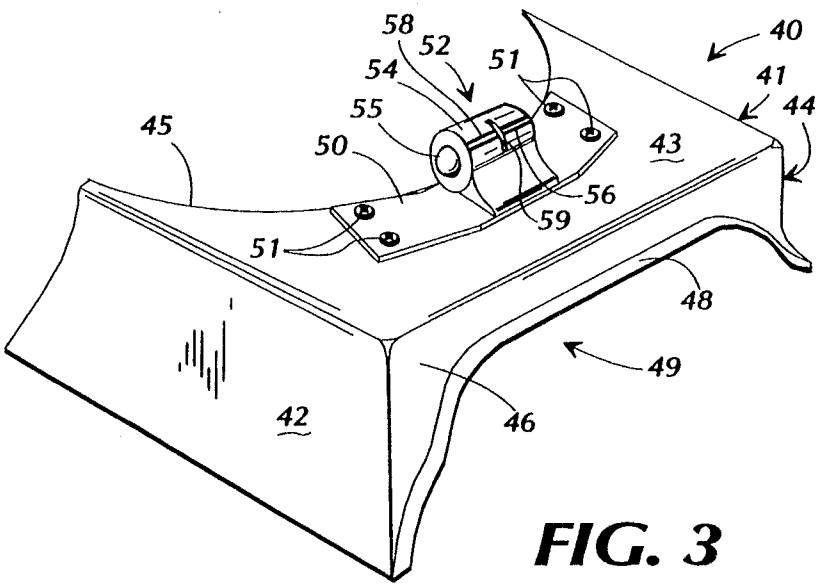
FIG. 3 illustrates a hood assembly that embodies principles of the present invention in one preferred form.

FIG. 3 illustrates a preferred embodiment of the vision limiting device, or hood 40, of the present invention. The hood 40 comprises a relatively small unitary frame structure 41 having a generally inverted U-shape when in its operative position. The frame structure 41 includes a top wall 43 joining two spaced side walls 42 and 44, wherein the side walls 42 and 44 extend at approximately 90 degree angles from the top wall 43 so as to provide side shields for the aviator when the hood is worn. The frame structure 41 also includes a concave inner edge 45 that is shaped and configured to conform to the unique curvature of the central front outer portion of the helmet (FIG. 4) and to conform to the curvature of the mounting structure shown in FIG. 4. A front outer wall 46 connects the top wall 43 and side walls 44, wherein the front outer wall 46 includes a lip 48 which defines a generally inverted U-shaped cutaway opening 49. In operation, an aviator would view through the opening 49 and be prevented from using his or her peripheral vision by the side walls 42 and 44 of the hood 40.

A bracket 50 is attached by screw threaded means 51 onto the top wall 43 of the frame structure near the inner edge 45 thereof. The bracket supports a quick coupling means 52, which comprises a cylinder 54 having a spring loaded ball 55 on each end thereof (only one of which is shown). Cylinder 54 includes at least two grooves, shown as 56 and 58 which run longitudinally along the full length of the cylinder 54, and a short transverse groove 59 running in the center between the grooves 56 and 58. These grooves are used to hold the hood in two different positions by means of a release knob on a mount 64 of mounting structure 61 (not shown). Thus, the aviator turns the knob in order to adjust the hood to be positioned in a stow position when not in use, and flipped down to its operative position, when necessary.

Figure 4:
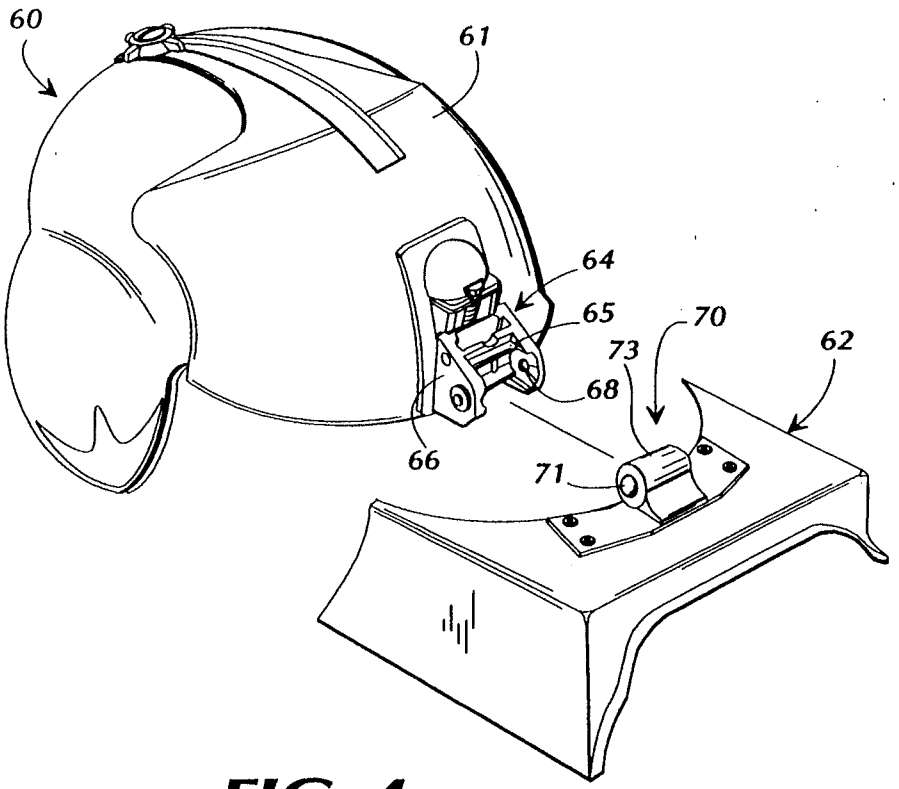
FIG. 4 is a perspective view showing the hood of FIG. 2 dismounted from the mounting structure and helmet.

FIG. 4 shows an Army SPH-4 helmet 60 and a mounting structure 61 which are identical to the helmet 26 and mounting structure 28 shown in FIG. 2. A hood 62 identical to the hood shown in FIG. 3 is ready for engagement with mount 64 on the mounting structure 61. Similar to mount 32 on FIG. 2, mount 64 comprises two opposite opposed spaced side members 65 and 66. Lock sockets 68 and 69 (only one of which is shown) are formed to receive quick coupling means 70 of the hood 62. In operation, the helmet 60 with the mounting structure 61 attached thereon would be placed over an aviator's head, and the aviator would manually position the cylinder 73 of the coupler 70 of the vision limiting device 62 between the side members 65 and 66 of the mount 64. Spring loaded balls 71 (only one of which is shown on each side of the cylinder 73) would then be pressed into the lock sockets 68 and 69, wherein the sockets are formed of a size to frictionally support the spring loaded balls 71. It is noted that the vision limiting device 62 can be rotated about the balls and sockets either to an overhead stow position (as described in FIG. 3) or down in the line of sight of an aviator.

The present invention provides a hood herewithin described which is easily attachable and detachable from the mounting structure of the helmet without the requirement of adapting a different mounting structure for mounting the hood. The ANVIS goggle system and the hood of the invention, therefore, are totally interchangeable using the same helmet with the same mounting structure attached thereon.

The invention has been described herein in terms of a preferred embodiment. It will be clear to those of skill in the art, however, that numerous variations might be made from the illustrated embodiment within the scope of this invention. For instance, the hood can be shaped in another configuration and still limit the sight of an aviator so as to provide the same results that the present invention provides. This and other additions, deletions, and modifications might well be made to the exemplary embodiment illustrated herein without departing from the spirit and scope of the invention.

I claim:

1. For use with an aviator's sound protective helmet having a front opening therein at least partially defined by depending, contoured edged ear coverings and having a top edge for permitting vision in forward, peripheral, upward and downward directions by the wearer, and further having a mounting structure thereon above the top edge of the opening; a vision limiting helmet attachment comprising:

a unitary hood frame structure having a first, operative, position and a second, inoperative, position, said frame structure having an inner edge adapted to abut the top edge of the front opening of the helmet when said frame structure is in the operative position; said frame structure having means for blocking the helmet wearer's vision in the upward direction comprising a top wall extending forwardly from said inner edge of said frame structure; said frame structure further having means for substantially completely blocking the helmet wearer's peripheral vision comprising two spaced, depending side walls joined by said top wall and coextensive therewith, each said side wall having a proximal end contoured to conform to the forward edges of the helmet ear coverings; said frame structure having means for blocking a portion of the helmet wearer's forward vision comprising a front wall depending from said top wall remote from said inner edge and joining said side walls, said front wall having a cutaway opening therein;

quick coupling means for releasably mounting said unitary frame structure to the mounting structure on the helmet in pivotal relationship thereto for pivoting between said operative and said inoperative positions; and bracket means for mounting said quick coupling means on said top wall of said unitary frame structure.

2. The vision limiting device for limiting vision of an aviator in a flight simulation as claimed in claim 1, wherein said inner edge is formed with a curved edge shape so as to conform to the curves of the front outer portion of the helmet.

3. The vision limiting device for limiting vision of an aviator in flight or in a flight simulation as claimed in claim 1, wherein said quick coupling means mounted on said unitary frame structure comprises a cylindrical connector having a spring loaded ball on each end thereof for registering lock sockets on with the mount on the mounting structure.

4. The vision limiting device for limiting vision of an aviator during flight or in a flight simulation as claimed in claim 1, wherein said cylindrical connector includes grooves which run along its full length and a short traverse groove in the center thereof for holding the vision limiting device in one of two positions relative to the helmet.

5. The vision limiting device for limiting vision of an aviator during flight or in a flight simulation as claimed in claim 1, wherein the mount of the mounting structure comprises a pair of spaced opposite and opposed side members having a channel therebetween and a lock socket on each of said members for releasably engaging with said quick coupling means of said unitary frame structure.

6. The vision limiting device for limiting vision of an aviator during flight or in a flight simulation as claimed in claim 1, wherein said bracket means is fastened to said unitary frame structure by means of screw threaded members.

* * * * *